US008020865B2

(12) United States Patent
Bober et al.

(10) Patent No.: US 8,020,865 B2
(45) Date of Patent: Sep. 20, 2011

(54) DEFLECTING NIP SHEET SHINGLING BUFFER MECHANISM

(75) Inventors: Henry T Bober, Fairport, NY (US); Eun Suk Suh, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 268 days.

(21) Appl. No.: 12/463,439

(22) Filed: May 11, 2009

(65) Prior Publication Data

US 2010/0283200 A1 Nov. 11, 2010

(51) Int. Cl.
*B65H 5/02* (2006.01)

(52) U.S. Cl. ..... 271/272; 271/273

(58) Field of Classification Search ..... 271/272, 271/273

See application file for complete search history.

(56) References Cited

U.S. PATENT DOCUMENTS

| | | | | |
|---|---|---|---|---|
| 5,727,784 | A * | 3/1998 | Sagawa | 271/265.01 |
| 5,775,689 | A * | 7/1998 | Moser et al. | 271/198 |
| 7,766,327 | B2 * | 8/2010 | DeGruchy | 271/272 |
| 2007/0029725 | A1 * | 2/2007 | Marx et al. | 271/272 |
| 2008/0073837 | A1 * | 3/2008 | DeGruchy | 271/273 |

* cited by examiner

*Primary Examiner* — David H Bollinger

(57) ABSTRACT

A novel media path mechanism which utilizes the position and/or motion of buffer nips to deflect the leading and trailing edges of the sheets entering the buffer to enable the sheets to be reliably shingled in the buffer media path. The sheets are stored in properly collated order until needed for insertion into the print stream. By shingling or overlapping successive sheets in close relationship in a row within the buffer, this process can greatly increase the volume of storage or parking of sheets within the buffer. This can significantly reduce the size or footprint of the buffer within the printing system or significantly increase the capacity of an existing system.

13 Claims, 5 Drawing Sheets

DEFLECTING NIP SHEET SHINGLING BUFFER MECHANISM

BACKGROUND

1. Field of the Technology

The present disclosure is applicable to methods and systems of storing cut sheet printed media in a sheet buffer, to be inserted into the media stream at the proper time to achieve correct and complete printing job sequence.

2. Description of the Prior Art

In many printing applications, especially with Multi Print Engine Color Hybrid Architectures, buffers allow the batching of the print output from one of the engines to maximize system productivity and reduce run cost. For example, in some of the proposed TIPP (Tightly Integrated Parallel Processing) architectures consisting of a mono and a color engine, there is a need to store color prints in the sheet buffer to minimize color engine start up and shut down cycles.

However, such sheet buffers typically add significant cost, and in the case of the Entry Production Color market, an increase in the precious footprint of the total printing system. The invention provides an efficient alternative to the prior art media path sheet buffer configurations, such as disclosed in FIG. 1.

SUMMARY OF DISCLOSURE

The invention is a novel media path mechanism which utilizes the position and/or motion of the Buffer Nips to deflect the Leading and Trailing Edges of the sheets entering the buffer and enable selected sheets to be reliably shingled in the Buffer Media Path. The sheets are stored in properly collated order until needed for insertion into the print stream. Utilizing the sheet buffer media path more efficiently, the "Shingled Sheet Buffer" should hold roughly three times more sheets than the traditional "Park in Place" or "Head to Tail" Media Path Buffers.

Various of the above-mentioned features and further features and advantages will be apparent to those skilled in the art from the specific apparatus and its operation or methods described in the example(s) and in the claims below. Thus, they will be better understood from this description of these specific embodiment(s), including the drawings (which are approximately to scale) wherein:

DETAILED DESCRIPTION OF DISCLOSURE

Figure 1:
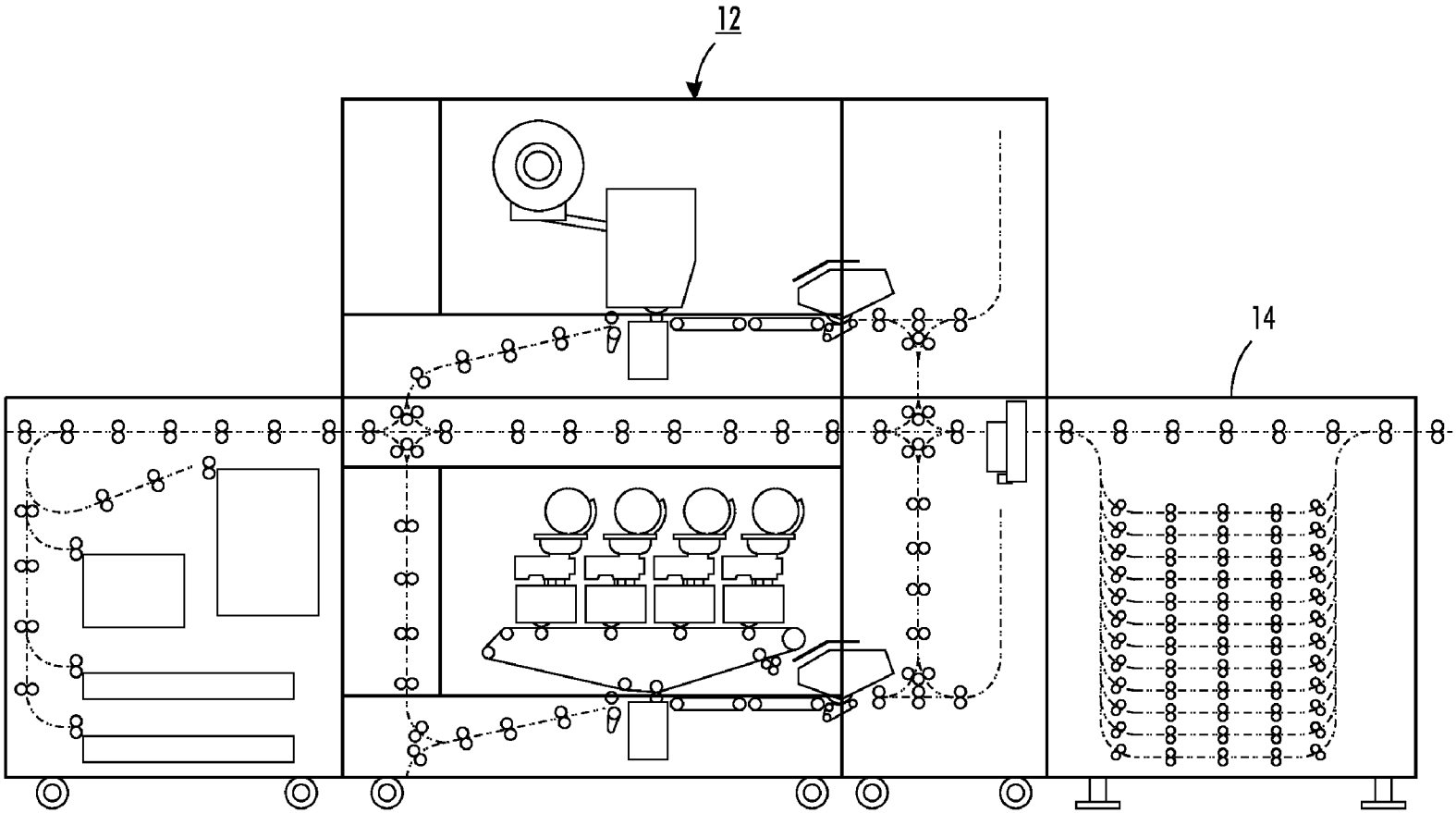
FIG. 1 PRIOR ART
FIG. 1 shows an exemplary prior art two engine hybrid color printing system.

With reference to FIG. 1, there is shown an exemplary Two Marking Engine Hybrid Color printing system 12, where mono and color printing engines are arranged in TIPP (Tandem Integrated Printing Processor) fashion, including one style of a classic prior art large foot print fixed capacity color print buffer module 14.

Figure 2:
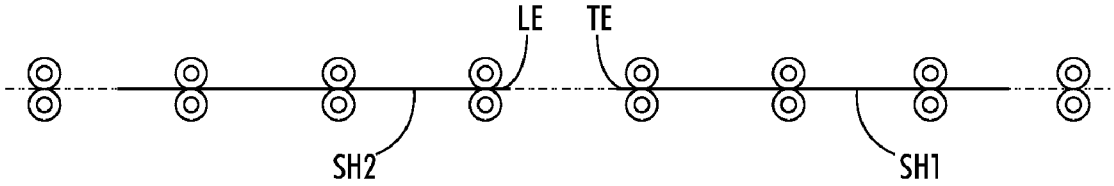
FIG. 2 PRIOR ART
FIG. 2 illustrates media path detail of a typical prior art buffer with head to tail sheet parking.

When a printing job with mixed pages (mono and color, but mono dominant) is processed, mono pages are printed on the mono engine on top, while color pages are printed on the color engine below. Efficient productivity necessitates the need for a sheet buffer module, where batch printed color pages are stored and inserted into the exit media path at the proper time. Typical prior art buffer modules have buffer configurations with sheets "parked head to tail" in the buffer paths illustrated in FIG. 2. As shown in FIG. 2, a first sheet, sh1, is shown in a prior art buffer with a second sheet, sh2. The sheets are head to tail, meaning that the leading edge LE of sh2 is parked just behind the trailing edge TE of sh1 and the sheets are separated by a small nominal distance. There is no overlap and the maximum space is used along the buffer media path for a given number of sheets.

Figure 3:
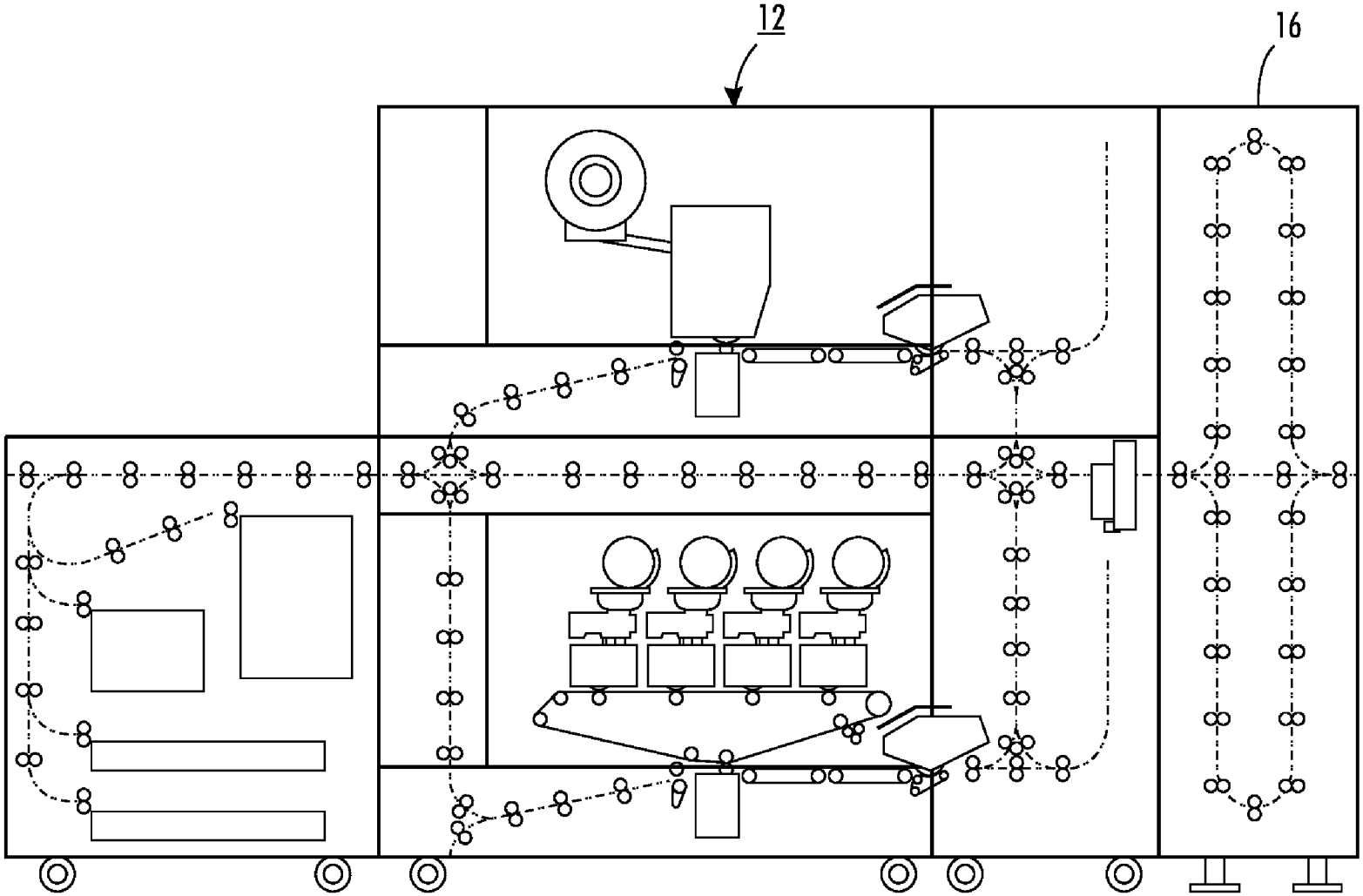
FIG. 3 is one of many possible architectures that would benefit from the shingling technology of the present disclosure.
Figure 4:
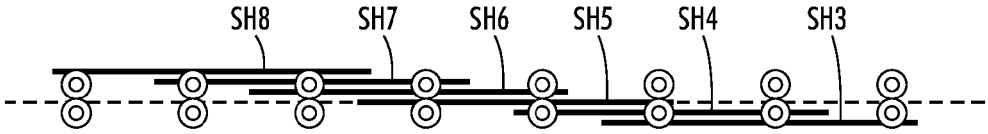
FIG. 4 illustrates sheet shingling in a buffer media path in accordance with the present invention.

The novel mechanism of the present invention allows sheets to be stacked on top of each other in a "shingled" manner without mixing up the print sequence. Sheet storage capacity can be increased significantly (approximately 3×) for a given length of buffer media path. FIG. 3 illustrates the printing system 12 of FIG. 1 with a more compact shingling buffer 16 in accordance with the present invention, holding 30 sheets as opposed to 24 sheets in the FIG. 1 buffer. Note the additional foot print and bulk required by the 24 sheet capacity color sheet buffer module 14 of FIG. 1 in comparison with the 30 sheet capacity color sheet buffer module 16 of FIG. 3. Sheet shingling is illustrated in FIG. 4 where 6 sheets, sh3, sh4, sh5, sh6, sh7 and sh8 are shown in overlapping relationship along a buffer media path.

The challenge with a shingling sheet buffer is to reliably position the lead edge of the entering sheet on top of the trail edge of the prior or previous sheet without stubbing. Stubbing would occur if the lead edge of a trailing sheet would strike, stub, or jam into the trail edge of the leading sheet to prevent overlap. By overlapping or shingling each sheet in a shingled sheet buffer media path could easily 'park' sheets every 100 mm to 150 mm of media path. This allows much more paper storage than parking sheets head to tail.

Figure 5:
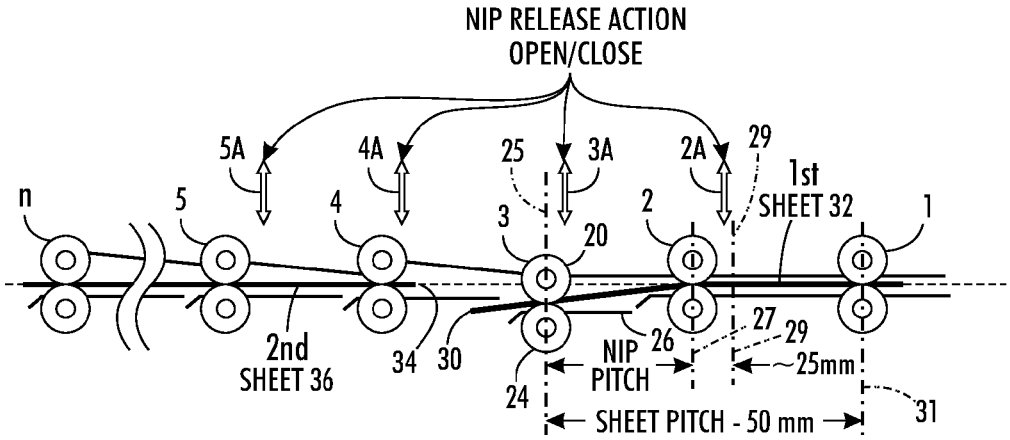
FIG. 5 shows a shingled sheet buffer using depressed translation nips in accordance with the present invention.
Figure 6:
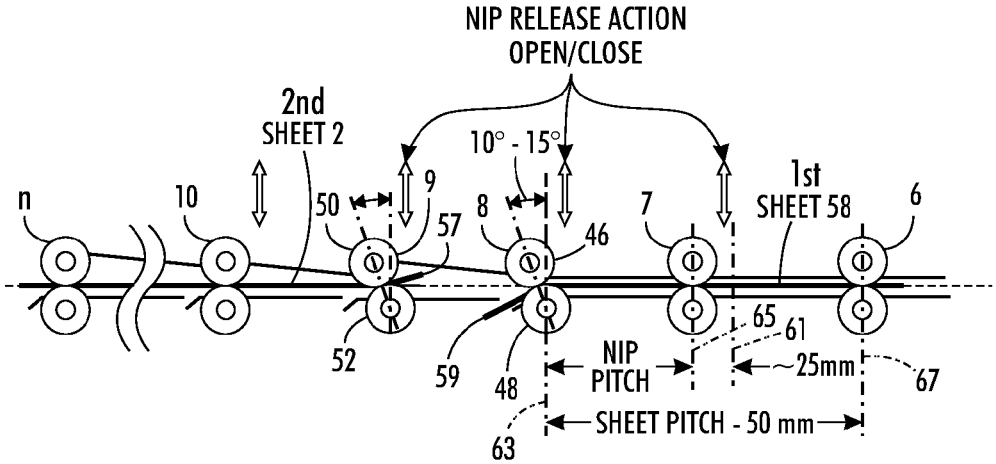
FIG. 6 shows a shingled sheet buffer using rotating nips in accordance with the present invention.
Figure 7:
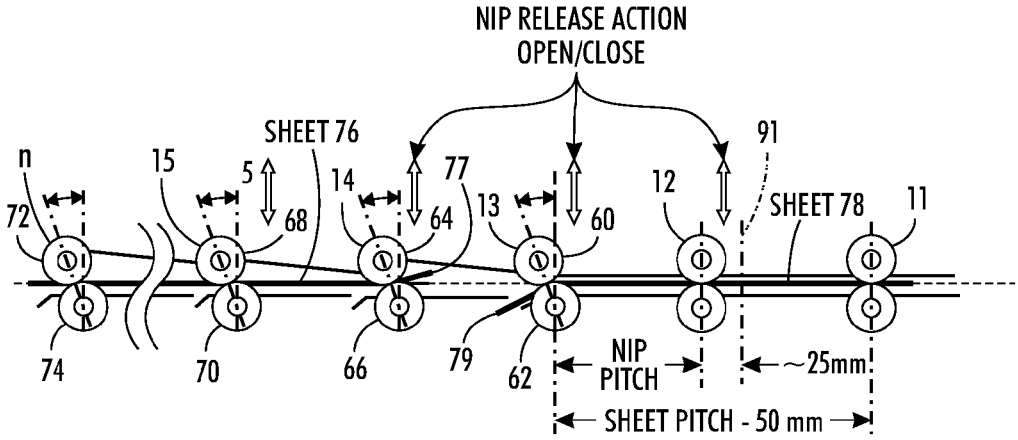
FIG. 7 shows a shingled sheet buffer using permanently rotated nips in accordance with the present invention.

Three implementations of this novel invention, shown in FIGS. 5, 6 and 7, utilizes the baffling and the position or motion of nip sets to deflect the entering lead edge and preceding trail edge to avoid stubbing while the entering sheet is introduced over the previous sheet with a significant overlap.

FIG. 5 illustrates shingled sheets being loaded into a buffer using depressed translation nips. For purposes of explanation, a set drive and idler rolls comprise a nip. As illustrated, there are shown six nips, identified as 1, 2, 3, 4, 5, and n, each with a drive roll and idler roll and also including a contoured lower baffle. Nip n would be the last nip in a set of nips comprising the sheet path from entry into the buffer to exit from the buffer at nip 1. In general, in this embodiment, a selected nip and contoured lower baffle is cyclically translated down to depress the trail edge of a first sheet and allow the lead edge of a following sheet to shingle over it. For each nip, in addition to this downward movement of nip and contoured lower baffle as required, there is a closed position of drive and idler rolls to contact the sheet and drive it forward or an open position of the drive and idler rolls to allow a sheet to be driven freely by a preceding nip. This open and closed movement is shown by arrows 2A, 3A, 4A, and 5A. This embodiment operates in the following sequence.

As shown, nip 3 is depressed. Specifically, drive roll 20, idler roll 24, and contoured lower baffle 26 lower the trail edge 30 of sheet 32 to allow lead edge 34 of sheet 36 to shingle over or overlap the trail edge 30 of sheet 32. In this example, the drive roll 20, idler roll 24, and contoured lower baffle 26 are selectively depressed approximately 10 mm to 20 mm in relation to the other nips. Next, nip 4 and nips 5 through n are selectively activated until the lead edge 34 of the sheet that is trailing sheet 32 has been driven to clear the trail edge of sheet 32 and is ready to enter nip 3. Notice the projection of trail edge 30 of sheet 32 upstream of the centerline 25 of nip 3. Flexible guide strips (not shown) made of Mylar™, or some such commonly used media handling material may be employed in conjunction with each actuated nip as required to aid in the suppression of the trail edge of the downstream sheet when the individual nips are opened to receive the incoming lead edge. At the point that the lead edge 34 moves above trail edge 30, nip 3 is raised up or retracted to its home position. Nips 2 and 3 are opened and nips 4, 5, and n continue to advance the sheet following sheet 32 until its lead edge 34 reaches a nip 2 stage point. This stage point is illustrated to be approximately 25 mm from centerline 27 and is illustrated at 29. This point triggers the arrival of the trailing sheet at nip 3 and the closure of nips 2 and 3, positioning the trailing sheet in a significant overlap relationship with sheet 32.

Note that the distance between centerline 25 of nip 3 and centerline 27 of nip 2 is defined as the nip pitch. This pitch or distance between nips along the buffer sheet path generally varies from 100 mm to 150 mm. The nip pitch distance is generally a function of the type and size of the media being driven through the nips and the size of the nip rollers. Sufficient distance is preferred to allow the trailing edge 30 to be tilted downward. Also, as shown, a sheet pitch, or sheet length is defined as the approximate distance of two nip pitches plus 50 mm. In other words, a sheet will extend between nips 1 and 3, as an example, with portions of the sheet extending beyond centerlines 25 and 31. These separate extended portions, counted together, measure approximately 50 mm.

FIG. 5 illustrates the steps in preparation of parking or overlapping sheet 36 on top of sheet 32 in a media buffer. The next sheet entering the buffer behind sheet 36 would approach sheet 36 and nip 4 in a similar manner in an overlapping relationship on top of sheet 36. For this sheet, however, the drive roll, idler roll, and contoured lower baffle of nip 4 are selectively depressed, not nip 3. Then, nips 5 through n are selectively activated until the lead edge of the next sheet has been driven to clear the trail edge of sheet 36, now held in nip 4, and is ready to enter nip 4. At that point, nip 4 is selectively raised up or retracted to its home position. Nips 3 and 4 are opened and nips 5 through m continue to advance the next sheet until its lead edge reaches a nip 3 stage point. This stage point would be approximately 25 mm beyond the centerline of nip 3. In this manner, successive sheets are parked in the buffer by selectively depressing certain nips and selectively activating other nips.

FIG. 6 shows another embodiment of shingled sheets in accordance with the present invention. In this embodiment, the sheet buffer path comprises rotating nips. The drive and idler rolls of two adjacent nips are cyclically rotated from a vertical, approximately 10° to 15° CCW, to elevate the leading edge of a trailing sheet and to depress the trail edge of the leading sheet to allow the trailing sheet to shingle over the leading sheet. It operates in the sequence described below:

Nip 8, including drive roll 46 and idler roll 48, and nip 9, including drive roll 50 and idler roll 52, are rotated approximately 10° to 15° CCW as illustrated. Nips 9 through n are activated until the lead edge 57 of sheet 56 has cleared the trail edge 59 of sheet 58 and is ready to enter nip 8. Nips 8 and 9 are then rotated back to vertical and nips 7 and 8 are opened. Nips 9 through m continue to advance sheet 56 until the lead edge 57 of sheet 56 reaches a nip 7 stage point, shown at 61. At this point, both nips 7 and 8 are selectively closed, positioning sheet 56 in a significant overlap relationship with sheet 58.

Note again the definition of a nip pitch (centerline 63 of nip 8 to centerline 65 of nip 7) and the relationship of a sheet length or pitch in relation to the centerline 63 to centerline 67 distance between nip 6 and nip 8. Also, the nip pitch varies generally varies from 100 mm to 150 mm. A key factor in nip pitch is generally the size and type of the media being driven through the nips to allow the trailing edge of the forward sheet be tilted downward. Sufficient distance is preferred. FIG. 6 illustrates the steps of parking or overlapping sheet 56 on top of sheet 58 in a media buffer. The next sheet entering the buffer behind sheet 56 would be parked in a similar manner in an overlapping relationship on top of sheet 56. For this sheet, however, nips 9 and 10 would be rotated, instead of nips 8 and 9 and generally the same process would be followed to park the next sheet entering the buffer on top of sheet 56.

FIG. 7 shows a third embodiment. Shingled sheets are loaded into a buffer using nips permanently rotated. The drive and idler rolls of two adjacent nips are permanently rotated, approximately 10° to 15° CCW, to elevate the leading edge of a trailing sheet and to depress the trail edge of the leading sheet to allow the trailing sheet to shingle over the leading sheet. It operates with the following sequence:

Nips 13 through n, including drive rolls 60, 64, 68, and 72 and idler rolls 62, 66, 70, and 74, in this example, are permanently rotated approximately 10° to 15° CCW as illustrated. Nips 14 through n are selectively activated until the lead edge 77 of sheet 76 has cleared the trail edge 79 of sheet 78 and is ready to enter nip 13. Nips 12 and 13 are then opened. Nips 14 through m continue to advance sheet 76 until the lead edge 77 of sheet 76 reaches a nip 12 stage point. At this point, both nips 12 and 13 are closed, positioning sheet 76 in a significant overlap relationship with sheet 78.

Figure 8:
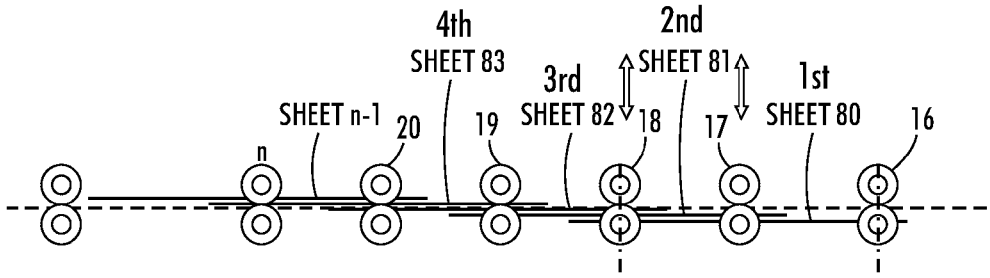
FIG. 8 depicts unloading a shingled sheet buffer in accordance with the present invention.

FIG. 8 illustrates the movement of the shingled sheets out of the buffer. In particular, the sheets are unloaded from the buffer when needed for proper introduction into the print stream. As illustrated, there are 5 sheets in the buffer, sheets 80, 81, 82, 83, and n−1 and a set of nips, 16 through 20 and n. Sheet 80 is the first sheet in the buffer or lead sheet. Distribution of sheets form the buffer operates with following sequence: Nips 17 and 18 are opened. Nip 16 advances until the trail edge 86 of sheet 80 clears nip 16. Nips 17 and 18 are then closed. All nips are then advanced 1 nip pitch. The process is then repeated. That is, nips 17 and 18 are opened to start the process.

Three exemplary implementations have been presented herein to describe the concept of a Deflecting Nip Sheet Shingling Buffer and one example of the unloading of the shingling buffer. Of course, other implementations are contemplated within the intent and scope of the present invention.

It should be apparent, therefore, that while specific embodiments of the present disclosure have been illustrated and described, it will be understood by those having ordinary skill in the art to which this invention pertains, that changes can be made to those embodiments without departing from the spirit and scope of the disclosure. Further, The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What we claim is:

1. A media device for storing a plurality of sheets along a media path comprising:

a plurality of media conveying nips positioned along the media path, a first set of the conveying nips, the first set of conveying nips being positioned relative to the media path for movement in a vertical direction for deflecting a second sheet in an overlap relationship with respect to a first sheet, a second set of the conveying nips for advancing the second sheet in the overlap relationship with respect to the first sheet, and a stop nip of the conveying nips for stopping the second sheet in a substantial overlap position with respect to the first sheet.

2. The device of claim 1 including a third set of the conveying nips for selectively unloading sheets from the media path.

3. The device of claim 1 wherein the first set of conveying nips are rotating nips.

4. The device of claim 1 wherein the first set of conveying nips are permanently tilted nips.

5. A method for overlapping a second sheet having a leading edge on a first sheet having a trailing edge along a transport path, the sheet path including a translation nip, a set of advancing nips, and a stopping nip comprising:

depressing the translation nip holding the trail edge of the first sheet, moving the leading edge of the second sheet by the advancing nips beyond the trail edge of the second sheet, retracting the translation nip, opening the translation nip and the stopping nip, continuing moving the leading edge of the second sheet to the stopping nip, and closing the translation nip and the stopping nip.

6. A method for overlapping a second sheet having a leading edge on a first sheet having a trailing edge along a transport path, the sheet path including an adjustable nip and a stopping nip comprising:

positioning the adjustable nip holding the trail edge of the first sheet to receive the lead edge of the second sheet, moving the leading edge of the second sheet beyond the trail edge of the first sheet, retracting the adjustable nip, opening the translation nip and the stopping nip, and moving the leading edge of the second sheet to the stopping nip.

7. The method of claim 6 wherein the adjustable nip is a rotating nip.

8. The method of claim 6 wherein the adjustable nip is a vertically moving nip.

9. A method for overlapping a second sheet having a leading edge on a first sheet having a trailing edge along a transport path having sheet conveying nips comprising the steps of:

lowering the trail edge of the first sheet relative to the lead edge of the second sheet, including the step of adjusting a first nip along the transport path, advancing the leading edge of the second over the trail edge of the first sheet, and moving the leading edge of the second sheet to a fixed position relative to the first sheet.

10. The method of claim 9 including the step of depressing the first nip to lower the trail edge of the first sheet in relation to the leading edge of the second sheet.

11. The method of claim 9 including the step of rotating the first nip to lower the trail edge of the first sheet in relation to the leading edge of the second sheet.

12. A system for shingling media along a transport path including a first sheet having a trail edge and a second sheet having a leading edge comprising:

a translation nip, the translation nip, having an up position and a down position, and being positioned with respect to the transport path for movement with respect to the trail edge of the first sheet, a set of advancing nips, the advancing nips moving the leading edge of the second sheet over the trail edge of the second sheet, and a stopping nip, the stopping nip halting movement of the second sheet on top of the first sheet.

13. The system of claim 12 wherein the advancing nips move the leading edge of the second sheet over the trail edge of the second sheet with the translation nip in the up position.

* * * * *